US005516548A

United States Patent [19]

Chan et al.

[11] Patent Number: 5,516,548

[45] Date of Patent: May 14, 1996

[54] TUNGSTEN DISULFIDE MODIFIED BISMALEIMIDE

[75] Inventors: Jimmy C.-H. Chan, Granger; Betty H. Kocsis, South Bend, both of Ind.

[73] Assignee: AlliedSignal Inc., Morristown, N.J.

[21] Appl. No.: 377,072

[22] Filed: Jan. 23, 1995

[51] Int. Cl.[6] ..... B05D 7/14

[52] U.S. Cl. ..... 427/142; 427/287; 427/271; 427/289; 427/355; 427/388.2

[58] Field of Search ..... 427/142, 287, 427/289, 388.2, 355, 271

[56] References Cited

U.S. PATENT DOCUMENTS

| | | | |
|---|---|---|---|
| 3,950,571 | 4/1976 | McBride et al. | 427/142 |
| 4,996,085 | 2/1991 | Sievers | 427/142 |
| 5,049,606 | 9/1991 | Yamaya et al. | 525/149 |
| 5,316,790 | 5/1994 | Chan et al. | 427/142 |
| 5,382,333 | 1/1995 | Ando et al. | 204/130 |

*Primary Examiner*—Janyce Bell

*Attorney, Agent, or Firm*—Leo H. McCormick, Jr.; Larry J. Palguta

[57] ABSTRACT

A method of restoring a damaged surface of a metal substrate to a functional conditions through application of a filler material consisting essentially of bismaleimide and tungsten disulfide having a ratio of 10:1. The bismaleimide having been cured through the following sequence to maintain the durability thereof when exposed to aromatic fuels at temperatures up to 500° F., the temperature of the bismaleimide is uniformly raised from room temperature to 350° F. in one hour and maintained at 350° F. for an additional hour and thereafter the temperature is immediately raised to 475° F. and maintained at 475° F. for an additional two hours.

3 Claims, 1 Drawing Sheet

TUNGSTEN DISULFIDE MODIFIED BISMALEIMIDE

This invention relates to a tungsten disulfide and bismaleimide material for restoring metal surfaces that have been scratched, scored, grooved, worn or otherwise damaged, to a functional condition to operate under compressive loads at high temperatures (500° F.) to minimize costly repair procedures and reduce scrap. This material is particularly ideal for the repair of worn hydraulic pump housings, fuel control bodies and other bearing surfaces made of various metallic alloys such as copper, steel and aluminum which may be exposed to and/or operated in an aromatic fuel atmosphere.

BACKGROUND OF THE INVENTION

In is a common practice to repair scratches and worn areas on metal surfaces through welding or brazing and then machining the repaired surface to the original dimension. U.S. Pat. No. 5,316,790 discloses a process of repairing such scratches and worn areas through the use of a tungsten disulfide modified epoxy material. The repairs made through such epoxy material perform in a satisfactory manner as long as the temperature of the environment for the repaired metal is below 350° F. Unfortunately when the temperature of an environment exceeds 350° F., the bond between the epoxy and metal may deteriorate such that the epoxy degrades.

Other methods of repair of metals that are exposed to temperatures above 350° F. are available, such as welding and brazing; however, they are often costly and impractical. In addition welding and brazing do not provide corrosion protection, and may potentially induce galvanic corrosion as a result of the use of dissimilar metals. While corrosion protection for welding and brazing repaired surfaces can be achieved through various plating methods, such methods are costly, impractical and in some instances may be environmentally unsound and as a result have often not been accepted by most customers.

Upon reviewing the temperature requirements for repaired materials, it was determined that a repair material should have the following properties or characteristics: A low coefficient of friction; minimum porosity; good resistance to high aromatic aviation fuels and fluids; operating temperature range of at least 500° F.; and corrosion protection for a metallic substrates.

Furthermore, this material should provide a lubricated, easily machinable surface that could be applied in a single coating with a thickness of at least 0.006 inch to reduce time involved in making or restoring the component to a functional condition which will tolerate compressive loads. Known state of the art lubricant filled epoxy, as described in U.S. Pat. No. 5,316,790 and No. 3,950,571, have a maximum temperature limit of 350° F. and as a result have a limited application with respect to the repair of metal surfaces.

SUMMARY OF THE INVENTION

It was known that certain polyimides can maintain their operational characteristics when exposed to temperatures up to 600° F. for an extended period of time. Such polyimides identified as bismaleimides are derived from an addition reaction between unsaturated groups of imide monomers or oligomers. That is, unlike condensation polyimides, a bismaleimide undergoes polymerization by reaction of the maleimide double bond with another unsaturated system without the evolution of volatile byproducts and as a result may be cured in a manner similar to an epoxy. Bismaleimide, which is commercially available from Dexter Hysol Inc under the trade name Hysol EA9369, was selected for evaluation as a component to repair a damaged metal surface. This particular material has a specified overlap shear strength of 1800 psi and compressive strength of 3200 psi at 500° F. It consists of N,N'-m-phenylene dimaleimide, bisphenol F epoxy resin and amorphous silicon dioxide. Also, it is known to be a good corrosion barrier on various metallic substrates by virtue of its ability to insulate the metallic substrate from the environment.

From U.S. Pat. No. 5,316,790 it was known that tungsten disulfide is an acceptable high temperature lubricant filler material for repairing damaged surfaces of metal members. As a result a filler mixture consisting of tungsten disulfide and bismaleimide was prepared and applied to surfaces between strips of stainless steel and aluminum. These strips were cured in accordance to a process disclosed herein for a time period of approximately four hours. The strips were subjected to an overlap shear strength test in a 500° F. environment and yielded an average shear strength greater than 1800 psi. Later this mixture was applied to a damaged surface of a part to restore the surface to a functional condition. The excess material was removed from the part and the part was placed in an aromatic fuel enviroment. The mixture which has a minimum porosity acts as an environmental barrier to protect the part from deterioration.

An object of this invention is to provide a tungsten disulfide and bismaleimide material for restoring a damaged surface of a metal member to an operational functional condition in an environment wherein the temperature can reach 500° F.

DETAILED DESCRIPTION OF THE INVENTION

Figure 1:
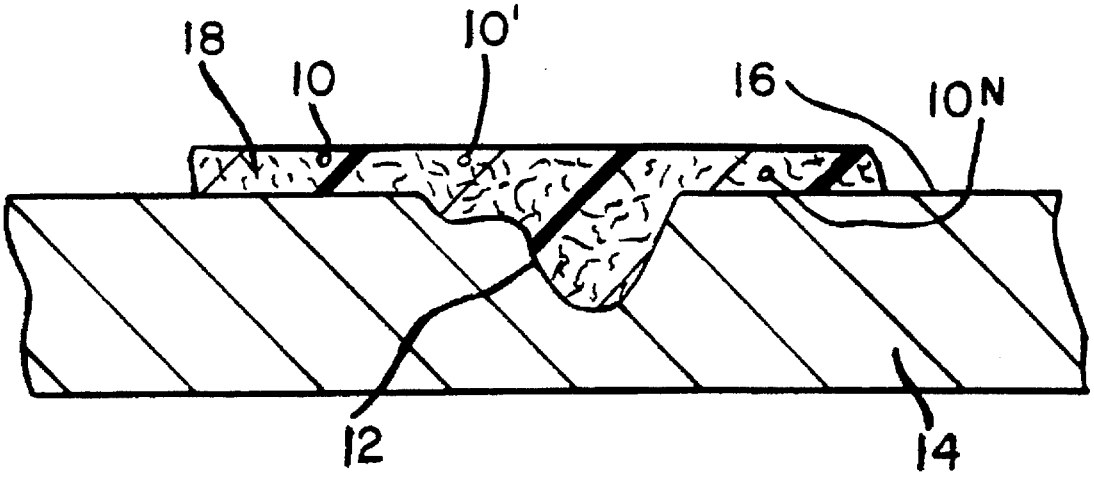
FIG. 1 is an illustration of a metal strip having a damaged surface repaired with a filler made according to the present invention.

In our research for a restoration material which would be able to function with a metal member in an environment at temperatures of 500° F. for an extended period of time, a modified bismaleimide filler was compounded to produce a mixture of bismaleimide and tungsten disulfide in a ratio of 10:1 by weight and mixed until homogeneous. It is important to note that in order to minimize porosity no solvent was used to thin the mixture. The tungsten disulfide had an average particle size of 1 to 2 microns and a silver-gray appearance. The resulting mixture was blended manually for fifteen minutes until uniform in consistency as noted by a uniform greenish-gray color. Overlap shear specimens were prepared according to ASTM D1002 using 2024-T3 aluminum anodized per MIL-A-8625 Type II Class 1 and grit blasted 304 CRES stainless steel strips (approximately 75 RMS surface finish). Degreasing consisted of an MEK wash immediately prior to application of the mixture.

The mixture was applied to a plurality of aluminum and steel test strips and placed in fixtures for curing in an oven. The mixture was used to join a first test strip to a second test strip to form an overlap shear test specimen and then cured in a programed oven according to the following schedule: the temperature in the oven was uniformly raised from ambient temperature to 350° F. in one hour which was followed by a one hour soak at 350° F. The ramp step is important because it improves the wetting of the substrate surface while allowing a gradual escape of volatiles from the bismaleimide thus minimizing the formation of air pockets or voids which reduce the strength of the material. The test strips were then removed from the fixtures and postcured for an additional two hours at a temperature of 475° F.

The test strips were evaluated without regard to the effect on the heat treatment of the aluminum since the behavior of the adhesive strength of the resulting joint was being examined and not the tensile strength of the aluminum. The aluminum test strips were divided into three groups and some of the test strips were exposed to Jet A Fuel at ambient temperature, some of the test strips were exposed to ASTM Fuel B at ambient temperature and the remaining aluminum and all of the steel test strips were exposed to environmental conditions at ambient temperature (75°–80° F.) and evelated temperatures to 550° F. The following table 1 illustrates the test results and failure modes for the test strips.

TABLE 1

| Type Test Strip | Condition | Shear strength (psi) | Avg. (psi) | Failure Mode |
|---|---|---|---|---|
| Anodized Aluminum | Room Temp. | 1600, 2100, 1600 | 1800 | Coating/ Cohesive |
| Anodized Aluminum | After 24 hrs. in ASTM Fuel B at Room Temp. | 2000, 1900, 1800 | 1900 | Coating/ Cohesive |
| Anodized Aluminum | After 24 hrs. in Jet A at Room Temp. | 1400, 1600, 1700 | 1600 | Coating/ Cohesive |
| 304 CRES | Room Temp. | 3200, 2900, 2700 | 2900 | Cohesive |
| 304 CRES | Pulled at 500° F. | 1900, 1900, 2200, 1400 | 1900 | Cohesive |
| 304 CRES | Pulled at 550° F. | 530 900 600 | 680 | Cohesive |

From the test performed on the samples it is evident that a significant reduction in overlap shear strength occurs between 500°–550° F. and as a result this bismaleimide and tungsten mixture should not be used to restore surfaces for components that are designed to operate in an environmental temperature above 500° F.

Figure 2:
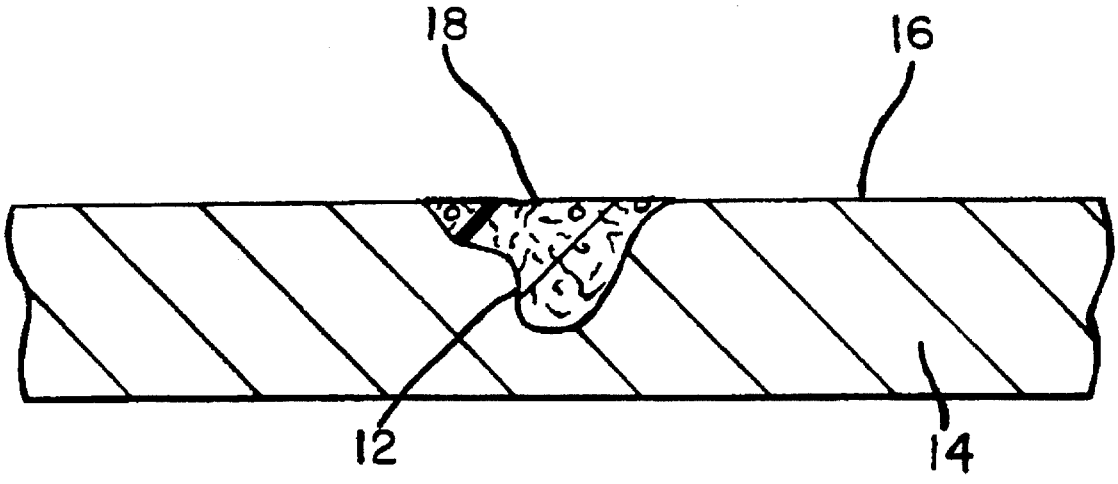
FIG. 2 is an illustration of the metal strip of FIG. 1 with some of the filler machined away to approximately the original surface dimension for the metal strip.

In order to evaluate the bismaleimide and tungsten mixture as a restoration material for damaged areas on a metal substrate, a groove 12, as shown in FIG. 1, of approximately 0.006 inch deep and one inch long was machined into the surface 16 of a 2×2 inch by ⅛ inch thick metal member 14 (304 CRES). The groove 12 which was then grit blasted to obtain a finish of approximately 60 RMS and filled with the bismaleimide and tungsten mixture 18 to a thickness of 0.008–0.010 inches. The metal member 14 was placed in a programed oven wherein the temperature was increased from room temperature (75°–80° F.) to 350° F. in one hour and maintained at 350° F. for an additional hour to cross-link the bismaleimide and thereafter the temperature was raised to 475° F. to further cure the bismaleimide for an additional two hours. The metal member 14 was allowed to cool to room temperature and the excess mixture machined away to approximate the original specimen thickness as shown in FIG. 2. The metal member 14 and the mixture 18 was examined under 10× magnification and no significant porosity was detected.

A thermogravimetric (TGA) analysis was performed on samples of the mixture 18 in an oxygen atmosphere. The samples were heated at a constant rate of 20° C. per minute and the samples exhibited a 2% weight loss at 500° F. (260° C.) while the onset of major weight loss through degradation did not occur until temperatures of around 600° F. (350° C.) were reached.

From the experiments that were performed using the bismaleimide and tungsten mixture it has been determined that a maximum operating temperature with built in safety factor for this mixture as a repair or restoration material is around 500° F. since overlap shear strength drastically decreases around 550° F. and degradation will occur at about 600° F.

We claim:

1. A method of restoring a damaged and/or worn surface on a metal substrate to substantially conform with an original surface profile, said method comprising the steps of:

mixing a filler material consisting essentially of tungsten disulfide and bismaleimide together to obtain a uniform mixture;

applying a quantity of filler material on said damaged and/or worn surface;

placing said metal substrate in an oven;

uniformly raising the temperature of said oven and said metal substrate to define a cure cycle for said bismaleimide, said cure cycle including: a one hour ramp from room temperature to a cure temperature of 350° F.; a one hour maintenance period at a temperature of 350° F.; and a post cure of two hours at a temperature of 475° F., said cure cycle providing good surface wetting of said substrate and a gradual release of any volatiles in said filler material while allowing cross linking of said bismaleimide in said filler material without significant porosity thereof; and machining any excess cured material from said damaged and/or worn surface to re-establish said original surface profile.

2. The method as recited in claim 1 wherein said filler material of bismaleimide and tungsten disulfide has a mixture ratio of 10:1 resulting in said filler material being easily machinable to said original surface profile after completion of said cure cycle.

3. The method as recited in claim 1 wherein said filler material of bismaleimide and tungsten disulfide has a mixture ratio of 10:1 and said tungsten disulfide having an average particle size of 1 to 2 microns, said filler material when cured during said cure cycle is essentially porosity free to provide corrosion protection for the underlying metal substrate.

* * * * *